US005495094A

United States Patent [19]

Rowan et al.

[11] Patent Number: 5,495,094

[45] Date of Patent: Feb. 27, 1996

[54] CONTINUOUS STRIP MATERIAL INDUCTION HEATING COIL

[75] Inventors: Henry M. Rowan, Rancocas; John H. Mortimer, Mt. Laurel, both of N.J.; Don L. Loveless, Sterling Heights, Mich.

[73] Assignee: Inductotherm Corp., Rancocas, N.J.

[21] Appl. No.: 422,416

[22] Filed: Apr. 14, 1995

Related U.S. Application Data

[63] Continuation-in-part of Ser. No. 225,130, Apr. 8, 1994, abandoned.

[51] Int. Cl.[6] ..... H05B 6/44

[52] U.S. Cl. ..... 219/645; 219/672; 219/673; 219/671

[58] Field of Search ..... 219/673, 639, 219/645, 646, 656, 671, 669, 637, 672

[56] References Cited

U.S. PATENT DOCUMENTS

| | | | |
|---|---|---|---|
| 2,676,242 | 4/1954 | Witsenburg | 219/671 |
| 2,689,296 | 9/1954 | Sabol | 219/653 |
| 3,301,991 | 1/1967 | Geisel et al. | 219/673 |
| 3,395,261 | 7/1968 | Leatherman et al. | 219/673 |
| 3,446,930 | 5/1969 | Seulen et al. | 219/673 |
| 3,472,987 | 10/1969 | Viart | 219/656 |
| 3,741,280 | 6/1973 | Kozheurov et al. | 219/646 |
| 3,766,353 | 10/1973 | Barbieux | 219/645 |
| 4,778,971 | 10/1988 | Sakimoto et al. | 219/671 |
| 5,156,683 | 10/1992 | Ross | 219/645 |
| 5,317,121 | 5/1994 | Katayama et al. . | |
| 5,345,065 | 9/1994 | Reinke et al. | 219/673 |

*Primary Examiner*—Philip H. Leung
*Attorney, Agent, or Firm*—Seidel Gonda Lavorgna & Monaco

[57] ABSTRACT

An induction heating coil apparatus for heating continuous strip material comprising at least a pair of generally rectangular full-turn coils arranged in parallel relation and separated from each other to permit continuous strip material to pass axially through the open interiors of the coils. Each coil has an opening in a first end portion thereof such that continuous strip material may pass into or out of the interior of the coil apparatus. The coil apparatus further comprises a pair of shunt conductors connecting the respective coils to each other. The shunt conductors are arranged on opposite sides of the openings in the end portions of the coils for providing a continuous current path from one rectangular coil to the adjacent coil. In one preferred embodiment there is an opening in the second end portion of one coil. Two more conductors, one on each side of this opening, provide connection to the respective poles of an alternating current power source. Other embodiments provide heating from two power supplies operating at a 180 degree phase relation to each other, adaptability to move between an open and a heating position, and include shaped portions in the coil turns for heating workpieces having irregular shapes.

10 Claims, 7 Drawing Sheets

CONTINUOUS STRIP MATERIAL INDUCTION HEATING COIL

This application is a continuation-in-part of application Ser. No. 08/225,130, filed Apr. 8, 1994 now abandoned.

FIELD OF THE INVENTION

The present invention is related to the general field of induction heating of metals, and to the specific field of galvannealing of continuous strip materials and irregularly shaped workpieces by induction heating.

BACKGROUND OF THE INVENTION

It has long been a practice in the metallurgy industry to employ induction heating means to galvanneal continuous strip metals, like strip steel, with other metal coatings (such as zinc or zinc-alloy) applied as liquids. The induction heating causes increased bonding into alloy phases between the strip material and the liquid metal coating. Galvannealed metals have known advantages over galvanized metals, such as better welding and painting characteristics and improved corrosion resistance.

One of the most demanding applications for galvannealing metal strip by induction heating is heating a steel strip from about 850 degrees to 1050 degrees Fahrenheit after the strip has been galvanized through a zinc bath. This type of strip is used extensively in automotive body panels.

A transverse flux type of induction coil is commonly used to heat thin metal strip. A coil or plural coils of this type are placed adjacent one or both sides of the strip and the strip is heated as it is conveyed past the coils. This arrangement does not completely surround the strip, and thus allows for easy insertion and removal from the strip without access doors or coil disassembly. However, the current flow induced in the strip is in a loop that lies in the plane formed by the flat sides of the strip. This may result in poor temperature uniformity and overheating of the edges of the strip. A transverse flux coil with good heating uniformity is a complex design and very expensive to produce.

For the above reason, induction heating of metal strip is usually done using a coil that is of solenoidal construction. As used herein, the term solenoidal means that the inductor completely surrounds the strip. This causes induced current in the strip to flow around the cross-section of the strip. However, a problem with such a coil is that it cannot be easily displaced laterally relative to the strip, or the strip relative to the coil.

One technique for facilitating removal of strip from solenoidal induction coils is to provide a door in the end of each coil, which opens to allow the strip to pass through the end of the coil. This technique has disadvantages in that opening the door breaks the high current path. Complex mechanisms are required to open the door, close the door and insure that electrical contact capable of high current is re-established. This results in high initial cost and shorter useful product life, and may cause eventual failure of the system due to catastrophic arcing.

The design of the present invention satisfies the requirements to disengage the induction coil assembly and to move it away from the strip without resorting to the use of current carrying doors or other complex mechanisms in the induction coils. The present invention provides the heating characteristics of the solenoid induction coil combined with an open end allowing easy disengagement from the strip.

Where it is necessary to induction heat workpieces of irregular size and shape, an embodiment of the present invention is adapted to have half-turns of the coil sections shaped to closely conform to the specific shape of the workpiece. The heating apparatus is energized by two power supplies operating at a 180 degree phase relation to provide opposing current flows in the respective coil sections.

SUMMARY OF THE INVENTION

The present invention is an induction heating coil apparatus comprising a plurality of half-turns which are connected together and extend transversely relative to the metal strip to form nearly complete solenoidal coils substantially surrounding the strip. The nearly complete solenoidal coils are spaced apart in a direction along the length of the strip to reduce electromagnetic coupling between them. One or more power sources provide high frequency electric current to the induction heating coil assembly.

In one embodiment, the coils are constructed of a continuous piece of conductive material. In this embodiment, current flows from the power source through one half-turn of a first coil and through an interconnecting portion to a second coil comprising a pair of connected half-turns forming a nearly complete solenoid coil. The current then traverses a second interconnecting portion to the second half-turn of the first section and returns to the power source.

In another preferred embodiment of the invention, the current in a first path flows first through one half-turn on one side of the continuous strip material, then through an interconnecting bus to a second half-turn on the same side of the strip and back to the power supply. In like manner, current in the second path flows through the two half-turns located on the opposite side of the continuous strip material in the opposite direction.

The unique arrangement of the coil turns of the present invention results in current paths similar to those in a helically-wound solenoid coil. A coil according to the invention is capable of inducing current flow in the metal strip which will cause the strip to be heated as it would be with conventional continuous turn coils. Coils having more than two solenoid-like current paths are possible and fall within the scope of the present invention.

At one end of the induction coil assembly opposite the input power connection, there is a gap between the bus conductors interconnecting the half-turn coils through which the continuous strip material can pass. This feature permits the multiple-turn coil apparatus to be moved into place, virtually encircling the strip material, without either partial disassembly or a need for complex door assemblies in the coil.

There are embodiments of the present invention which are adapted for use with two power supplies. These embodiments comprise two coil sections. The configuration of the coil sections permits the respective coil sections to be energized by separate power supplies. Operating the power supplies at a 180 degree phase relation to each other at substantially equal amplitude (i.e., the output currents are 180 degrees out of phase with each other) provides the same opposing currents in both the respective half-turns of each full-turn coil, and in adjacent full turns, as in the previously described forms. The apparatus adapted for use with two power supplies retains the gap at one end of the apparatus for permitting the edgewise entry of strip material into the apparatus. However, it may also be adapted to be moved between an open position, for loading workpieces into the apparatus, and a heating position wherein the apparatus encircles the workpiece for induction heating.

Another adaptation permits the induction heating of irregularly shaped workpieces according to the present invention. Where the workpiece is not a uniform strip material, but has instead a varying diameter, thickness, or combination of irregular dimensions (such as a crankshaft or machine part), the half-turns comprising each full turn of the coil apparatus may contain portions shaped to fit in close conformity around the specific dimensions of a part of the workpiece. The respective half-turns of the coil apparatus complement each other so that, when brought together, the shaped portions of the half turns cooperate to enclose the workpiece within them, each full turn conforming to the shape of the particular part of the workpiece it surrounds. This embodiment of the invention is driven by two power supplies operating at 180 degree phase relation to each other and is adapted for movement between an open position and a heating position.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DESCRIPTION OF THE INVENTION

The present invention is an induction coil apparatus which combines a plurality of half-turns of induction coil. The half-turns are connected at one end by a pair of conductor segments which define a gap in that end of the coil apparatus, opposite the power supply end. This gap permits a strip material to be placed into or removed from the coil apparatus freely, eliminating the necessity for a complex door assembly.

Figure 1:
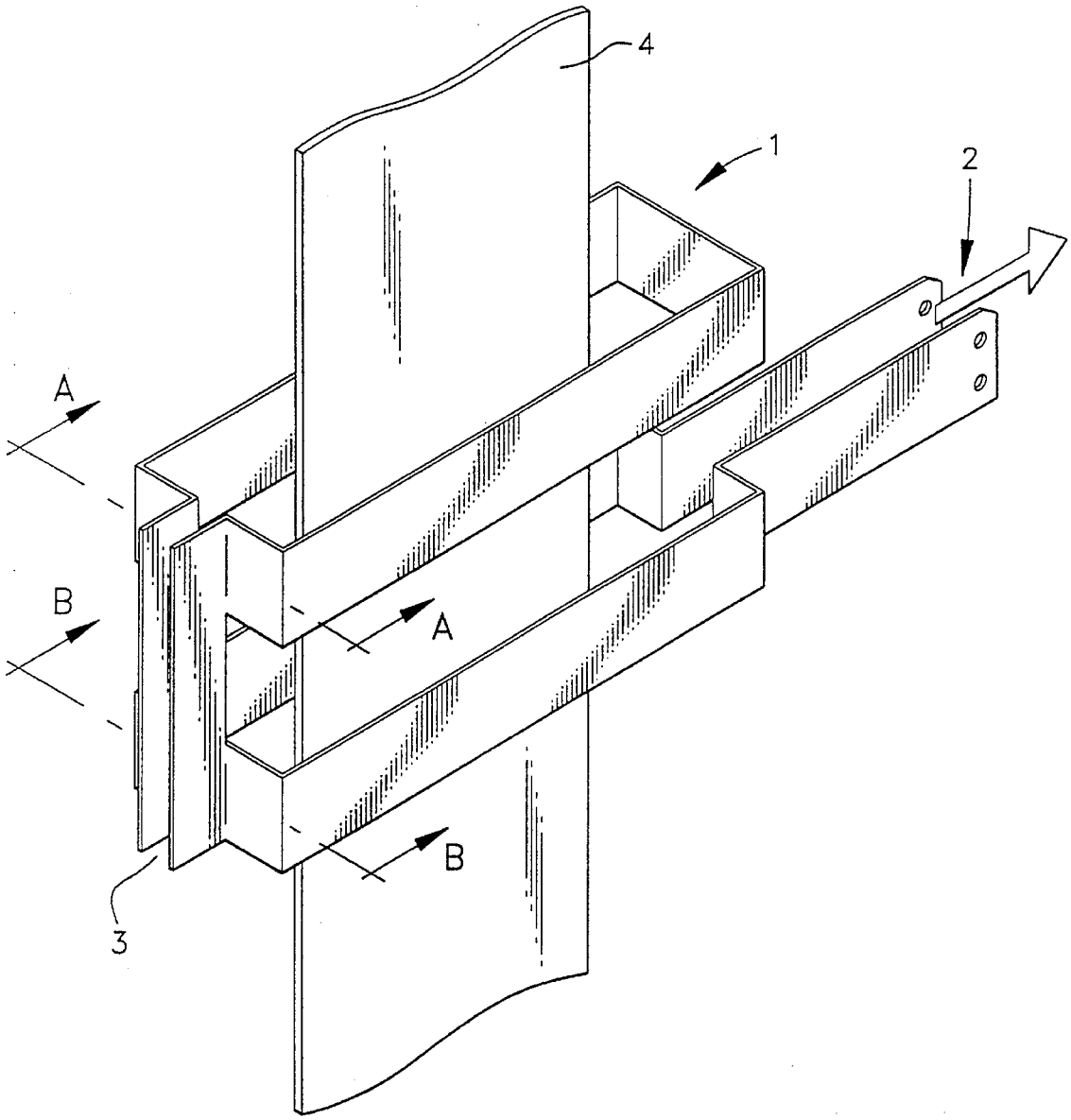
FIG. 1 is a perspective view of a first embodiment of the induction coil apparatus, with a section of metal strip shown within the apparatus in the heating position.

The present invention may be embodied in several forms. FIG. 1 is a perspective view of an induction heating coil apparatus according to a first embodiment of the invention, in which the coil is formed by a continuous piece of electrical conductor. The induction coil 1 is connected to a power supply (not shown) at one end 2 and defines an opening or gap 3 at its other end. A section of metal strip 4 is shown inserted into the interior of the coil 1 in the normal position for heating operations.

The gap 3 permits the induction coil 1 to be moved across the metal strip 4, and to be later removed, without breaking or opening any part of the coil 1.

Figure 2:
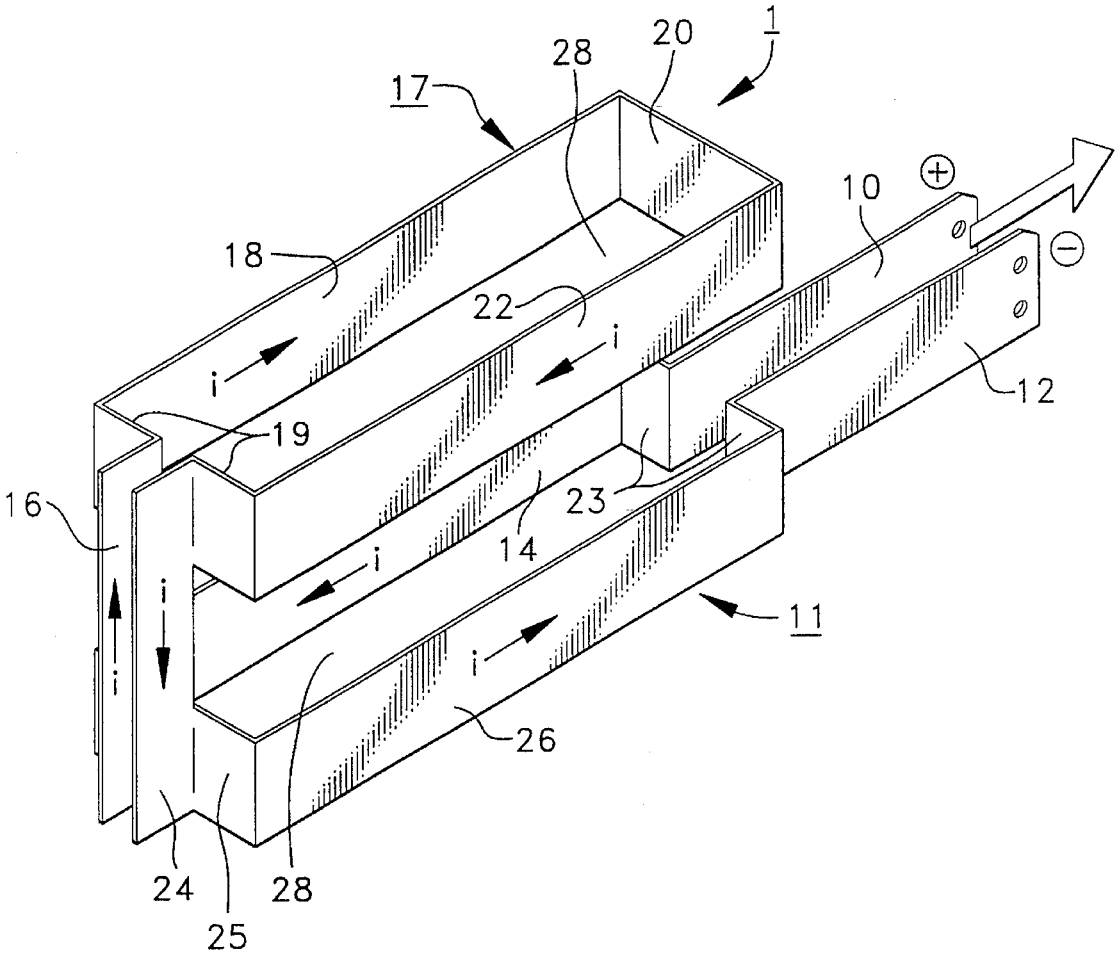
FIG. 2 is a perspective view of a first embodiment of the induction coil apparatus showing the paths for electric current flow.

The flow of electric current through the coil 1, at a given instant in time, is illustrated in FIG. 2. The apparatus is connected to a power supply of high frequency alternating current by terminal bus conductors 10, 12. The current flow at the given instant is in the path labeled with arrows i. The current flow is from terminal bus conductor 10 through the first half-turn 14 of what is the lower coil section 11 in FIG. 2. The current i then flows through an interconnecting portion 16, disposed generally parallel to the path of travel of the metal strip, to another half-turn 18 that is part of the upper coil section 17. From this half-turn 18 the current i flows through a short transverse portion 20 to the second half-turn 22 of the upper coil section 17 on the opposite side of the metal strip. The current i flows through another interconnecting portion 24, disposed parallel to portion 16, to the second half-turn 26 of the lower rectangular coil section 11. The current flow is completed as the current returns to the power supply through the second terminal bus 12. Of course, since the current is alternating current, the flow of current i is in the opposite direction on alternate half cycles of the current waveform. In this embodiment, the entire coil configuration described above is formed of a single conductor.

Preferably, the coils 11, 17 are generally rectangular and are arranged in parallel to and spaced apart from each other. Each coil is formed into its generally rectangular shape by electrical conductor portions comprising side portions (14, 26 and 18, 22) and a pair of opposed end portions (19, 20 and 23, 25) defining an open interior 28 in each coil 11, 17. This arrangement of the coils 11, 17 permits the continuous strip material to pass axially through the open interiors 28 of both coils for heating.

Efficient induction heating of metal strip requires selection of a proper frequency for the alternating electric current. In the present invention, the current in the inductor coil forms two current paths, as described above, around the strip material. If the frequency is high enough, the current induced in the metal strip will flow around the perimeter of the strip and penetrate the strip to a depth defined by the equation;

$$d = 3160\sqrt{\rho/\mu f}$$

Where:

d=depth in inches

ρ=resistivity in ohms-inches

μ=relative magnetic permeability f=frequency in Hertz

Figure 3A:
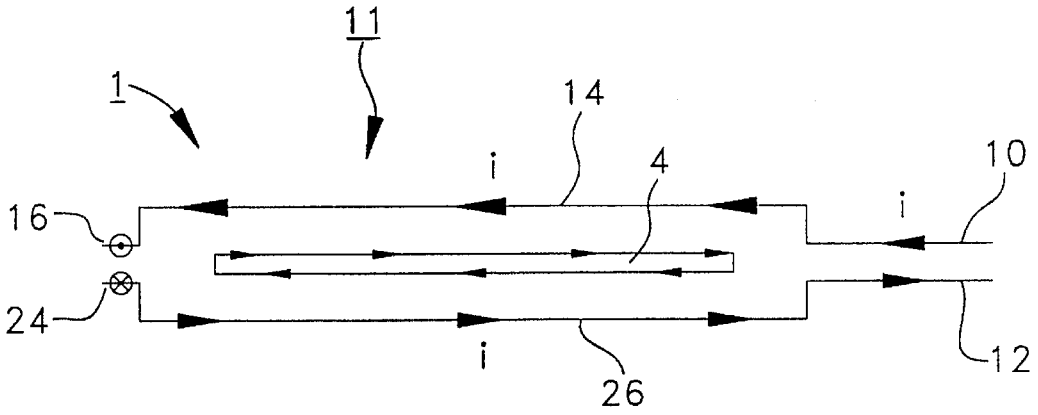
FIGS. 3A and 3B are sectional views of the upper and lower coil sections of the apparatus and the metal strip to be heated, taken along the lines A—A and B—B respectively, of FIG. 1.
Figure 3B:
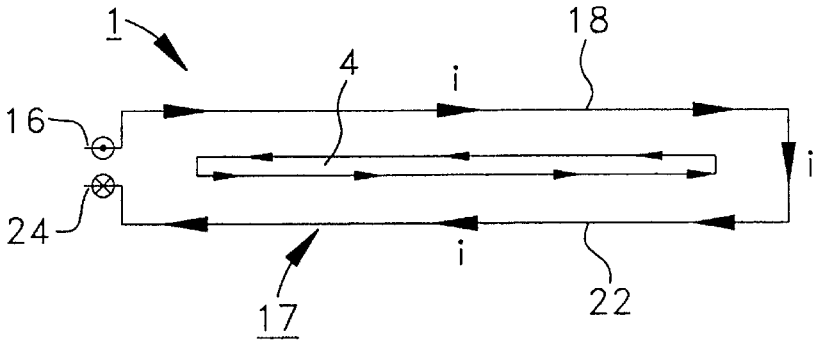

FIGS. 3A and 3B illustrate the respective current flows, at a given instant in time, in the induction coil apparatus 1 and in the metal strip 4 of FIG. 1. To clearly illustrate the solenoid-like current flow in the two coils 11, 17, a sectional view of each coil 11, 17, taken along the lines A—A and B—B in FIG. 1, is shown. In the lower coil 11, the current path i starts at the power input, passing through terminal bus 10 and half-turn 14 past one side of the strip to the interconnecting portion 16. This path continues through portion 16 to the same side of the upper coil 17. Current flows around the half-turns 18, 22 of the upper coil 17, then returns to the lower coil 11 through interconnecting portion 24 and past the opposite side of the strip in half-turn 26. This primary current path induces a current flow in the strip 4 that is the same as would be the case if a conventional continuous encircling solenoid turn were providing the current excitation in the strip 4. The current flow in the strip 4 is indicated by arrows pointing opposite that of the current i in the inductor coil apparatus 1.

Figure 4:
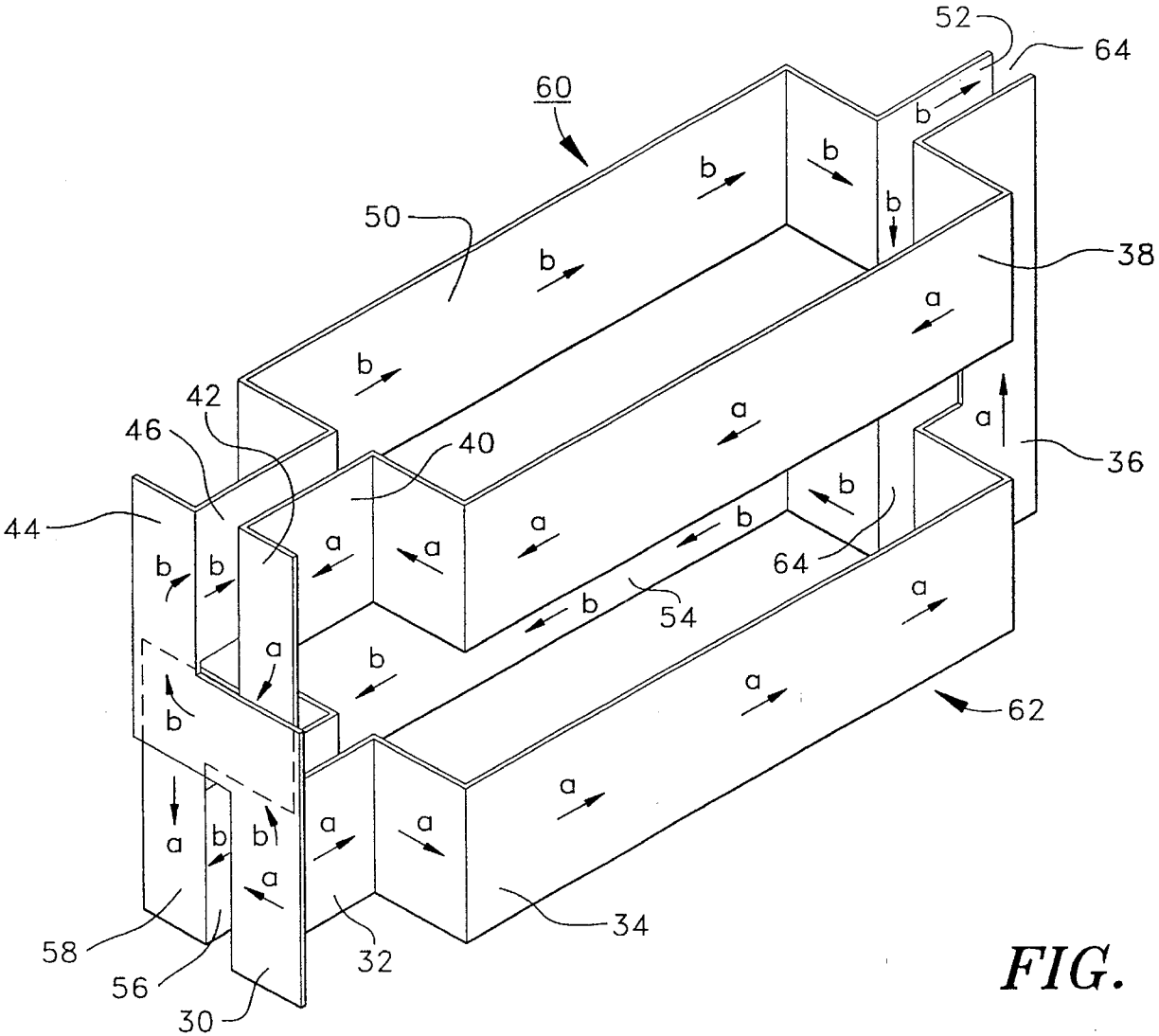
FIG. 4 is a perspective view of a second embodiment of the present invention, also showing the paths for electric current flow.

A second embodiment is illustrated in FIG. 4. In this embodiment, the current in complementary half-turns of each rectangular coil flow in opposing directions, the same as in the coil apparatus of FIG. 2. The current paths in the upper and lower coils also flow in opposite direction to each other, as in the coil apparatus of FIG. 2. Consequently, this embodiment also provides solenoid-like induction while providing a gap for insertion or removal of the strip material. However, in the embodiment depicted in FIG. 4, there are two separate current paths, labeled a and b respectively. Current path a flows in the two half-turns on one side of the coil apparatus; current path b flows in the half-turns on the opposite side.

In FIG. 4, the apparatus has upper and lower rectangular coils 60, 62 which are comprised of half-turn conductor segments as described below. These respective rectangular coils 60, 62 are interconnected by a pair of conductor segments 36, 52, disposed longitudinally to the path of travel of the metal strip and parallel to each other, defining a gap 64 between them. The strip material can pass through the gap 64 to facilitate its insertion or removal from the apparatus. Terminal conductor segments 30 and 44 are connected to one pole of an alternating current power supply (not shown). Terminal conductor segments 42 and 58 connect to the other pole of the power supply. Terminal segments 30 and 44 are interconnected to each other to create the two separate current paths a and b in the coil apparatus. Current from terminal conductor 30 flows through a short connecting bus 32 along the lower half-turn 34 of the lower rectangular coil 62 to the interconnecting conductor 36. The current returns along the upper half-turn 38 of the upper rectangular coil 60 through a short connecting portion 40 to the return terminal conductor 42 connected to the opposite pole of the power supply. Simultaneously, current flows through conductor 44 and the short conductor element 46 along the first half-turn 50 of the upper rectangular coil 60, down through interconnector bus 52 to the lower half-turn 54 of the lower rectangular coil 62, and returns to the power supply through connector portion 56 and terminal conductor 58.

The embodiment of FIG. 4 provides advantages over the embodiment of FIG. 2 in that its series impedance is about one third that of the series impedance of the coil apparatus of FIG. 2. The FIG. 2 coil apparatus, therefore, requires a supply voltage that is more than three times that required for the coil apparatus of FIG. 4. However, the apparatus of FIG. 2 is a simpler construction. Consequently, the specific use of the coil apparatus and characteristic of the power supply available will determine which embodiment is most practical.

It can be seen that the current flow in each rectangular section 60, 62 of the coil apparatus of FIG. 4 simulates that of two individual full-turn or solenoid coils. Furthermore, like the coil apparatus of FIG. 2, the current flows in opposite directions in the upper coil 60 compared to the lower coil 62. This requires that for highest efficiency the two sections must be physically displaced along the strip from the other, to prevent coupling of their magnetic fields, which would reduce efficiency.

As the spacing between coils is decreased to a point where the opposing induced fluxes interact, the efficiency tends to decrease. This is due primarily to partial cancellation of the electromagnetic field and some nonuniformity of current flow across the tums. A decrease in spacing will, on the other hand, tend to cause the efficiency to increase due to a shortening of the interconnecting conductors, which lowers resistance losses. Optimal spacing is realized where the curves plotting these effects intersect.

Optimal spacing also depends upon several parameters of the specific application. Some of these parameters, in order of significance, are:

1. Frequency
2. Material properties of the strip Magnetic permeability Conductivity
3. Geometry of the induction system Gap between coil turns and strip Width and length of the coil Thickness and width of the strip Width of the interconnecting conductor bars Air gap between interconnecting conductor bars
4. Flux concentrator (if used)
5. Intensity of the magnetic field
6. Final temperature of the heated strip.

It would be difficult if not impossible to define the interrelationship of the above parameters to give a specific value for the optimum spacing of the respective coil sections. Some basic analysis of coils with geometry typical of what would be used to heat carbon steel strip has been made. From this it may be concluded that a space between coil sections equal to 1.0 to 1.5 times the distance between the elongated side portions (18, 22 and 14, 26 of FIG. 2) is best. This spacing, with coils of opposite phase, is expected to yield less than 8% decrease in efficiency relative to coils having the same dimensions and operating in phase with each other.

Figure 5:
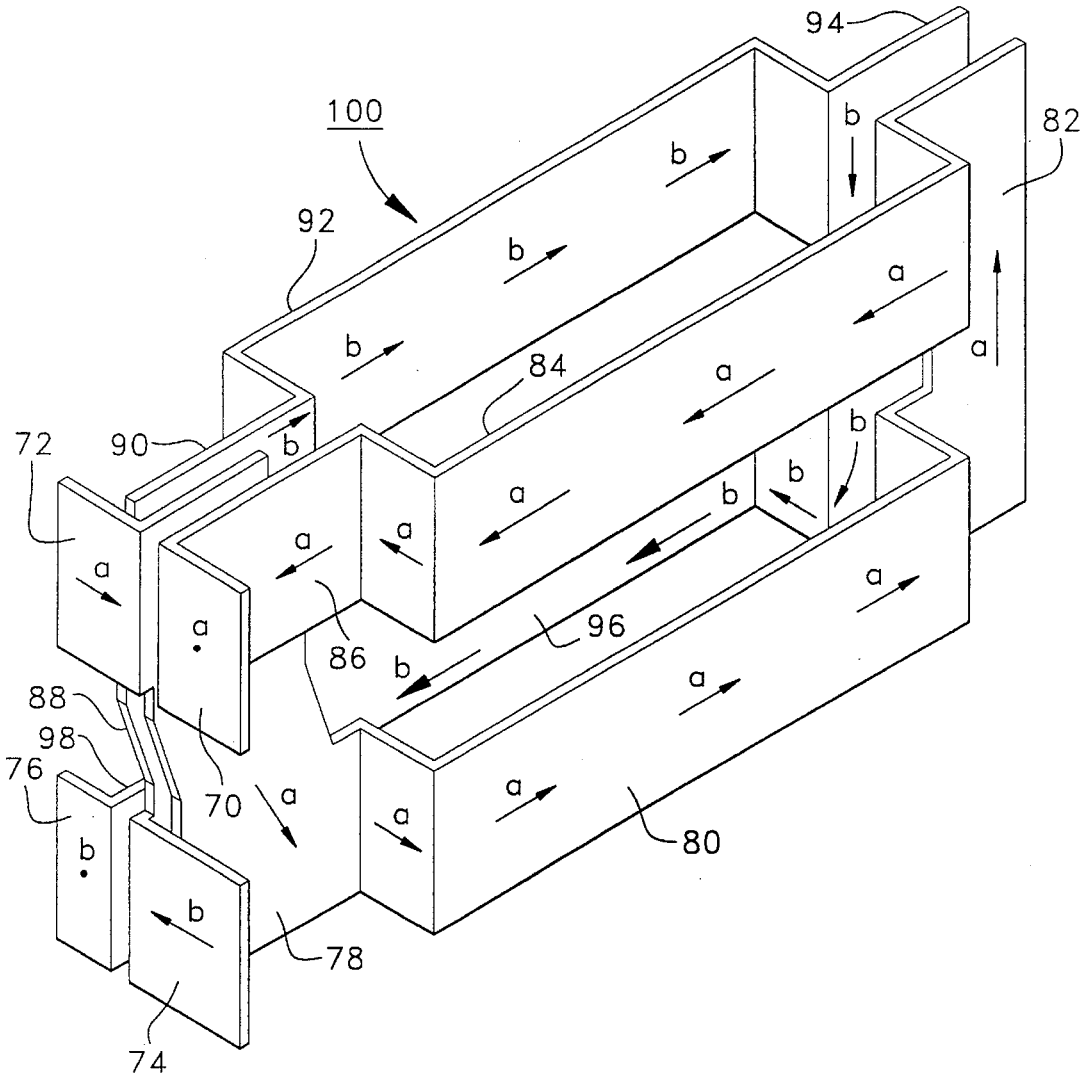
FIG. 5 is a perspective view of a third embodiment of the present invention, also showing the paths for electric current flow.

A third embodiment is illustrated in FIG. 5. The termination of this coil apparatus is arranged to permit the input of electric current from two power supply outputs. One power supply connects to the upper terminals 70, 72 and the other to the lower terminals 74, 76. The electric current provided to terminals 70 and 72 should be equal in amplitude and frequency to that provided to terminals 74 and 76, but approximately 180 electrical degrees out of phase. Driving the apparatus with unequal amplitude currents is possible, but not recommended. The magnetic coupling between the coil sections tends to cause one power supply to pull on the other when the amplitudes are unequal. Generation of such equal but opposite-phase currents can be accomplished in various ways. One is to supply the output current from a transformer or plurality of transformers wound and connected such that the secondaries are 180 electrical degrees out of phase.

The flow of electric current through the coil apparatus 100 of this embodiment, at a given instant in time, is illustrated in FIG. 5. The connections to the two power supplies of high frequency current are at the near end of the coil apparatus 100 shown in FIG. 5. The current flows from these connections in two paths labeled a and b. The current flow in path a is from terminal 72, driven by one power supply, through an extension portion 78 to the first half-turn 80 of the lower rectangular section in FIG. 5. Current a then flows through a shunt conductor 82 to another half-turn 84 that is spaced apart from the first half-turn 80. From half-turn 84, the current flows through the interconnecting conductor 86 to the return terminal 70 to the power source, completing current path a. Note that the path of current a is entirely on the front half of the coil apparatus 100 as it appears in FIG. 5.

The second path of current flow through the coil apparatus is labeled b. Beginning at terminal connector 74, connected to a second power supply, current b flows through the interconnecting conductor 88 and through the extension portion 90 to a half-turn 92, which completes the second half of the upper rectangular full-turn coil. From half-turn 92 the current flows through a shunt conductor 94 to another half-turn 96 that completes the second half of the lower rectangular full-turn coil. From this half-turn 96 the current flows through the extension portion 98 back to the return terminal 76 to the power source, completing the second current path. Note that current b is entirely on the rear half of the coil apparatus as it appears in FIG. 5.

The coil apparatus of FIG. 5 is preferred for several reasons. An important feature of this embodiment is that the induction coil apparatus can be constructed from two identical halves. This permits the movement of the respective coil sections between an open position, for loading a workpiece into the apparatus, and a heating position wherein the workpiece is enclosed within the coil turns for induction heating. There may be circumstances in which it is necessary to apply induction heating to a material which would be too large to fit through a gap in the end of the apparatus. The adaptation that permits opening and closing the apparatus to allow loading/unloading and heating such a workpiece makes this embodiment of the induction heating apparatus a more flexible equipment that may accommodate more than one type of workpiece. However, the coil apparatus shown in FIG. 5 retains the gap at one end between the shunt conductors 82, 94, permitting strip material to pass edgewise into the coil without the necessity of opening the apparatus, or a gate or door in the coil. Like the embodiment of FIG. 4, the series resistance of the FIG. 5 coil apparatus is considerably less than that of the coil shown in FIG. 1.

Each half of the apparatus, right or left as illustrated in FIG. 5, may be removed, repaired and replaced while leaving the other half connected to its respective power supply. This feature also allows easy access to the bore of the coil apparatus; that is, the inside surface of the coil conductors. This is the area exposed to highest temperature and is most likely to require periodic maintenance. Access to this bore area in a conventional continuous turn solenoid coil, with or without a door, is very limited, making this area difficult to maintain.

The subject continuous strip material induction heating coil, with two or more axially in-line coils operating with opposing fluxes, has a subtle advantage worth noting. The operation with equal and opposing fluxes dramatically reduces or eliminates the induction of current flow in the support structure caused by stray fields, and therefore minimizes the possibility of stray path arcing. With a conventional single solenoid coil, or multiple solenoid coils with aiding longitudinal flux, the inductive coupling to the supporting framework frequently causes arcing where the heated material touches the guides or support rolls. This can cause damage to the surface of the heated material, the guides or rollers and the roller bearings. In the case of paint curing, where the heating is done in an explosive environment, such arcing can be catastrophic and must be carefully avoided.

Figure 6:
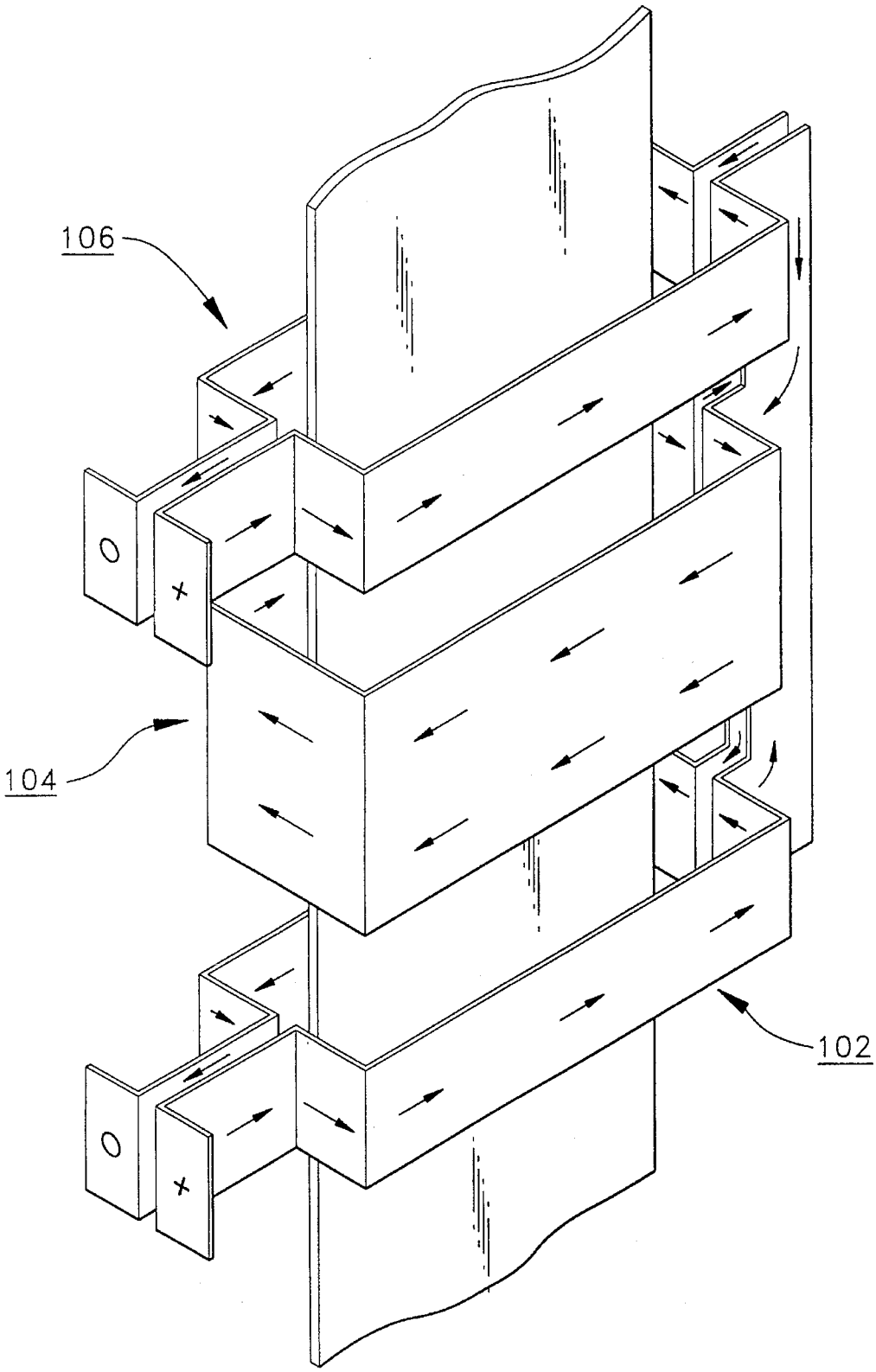
FIG. 6 is a perspective view of a fourth embodiment of the present invention, having three coil sections.

FIG. 6 is a perspective view of yet another strip heating apparatus which may be constructed according to the present invention. The arrows indicate the direction of current flow through the conductors of the respective coils 102, 104 and 104, 106. It should be noted that the current flow in adjacent coils (102, 104 and 104, 106) is in opposing directions. As in the previously described embodiments or the invention, the opposing current flow induces magnetic fields with opposing lines of flux between adjacent coil sections.

Figure 7A:
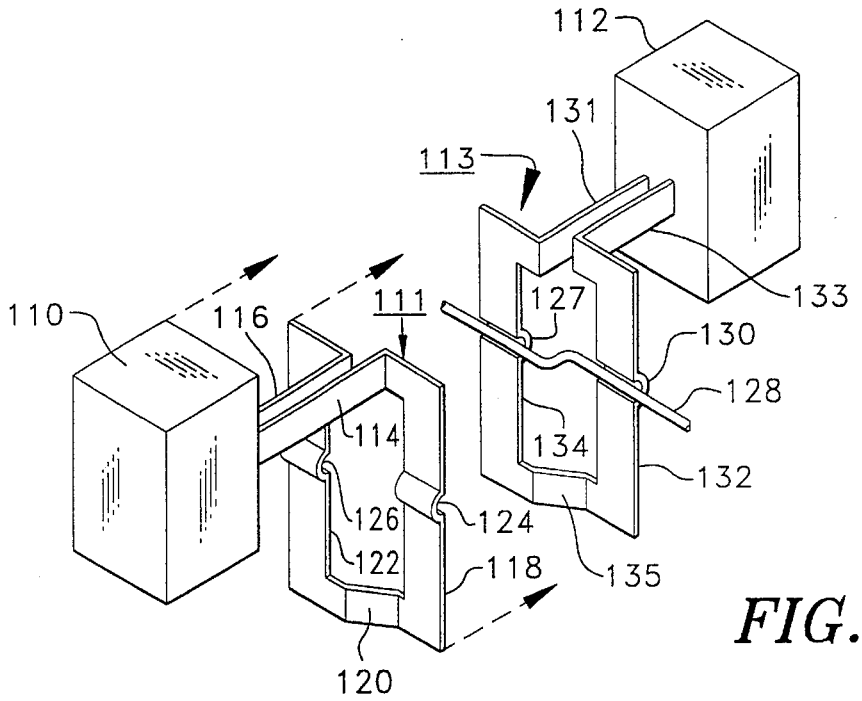
FIG. 7*a* is a perspective view of a fifth embodiment of the present invention in the open position.
Figure 7B:
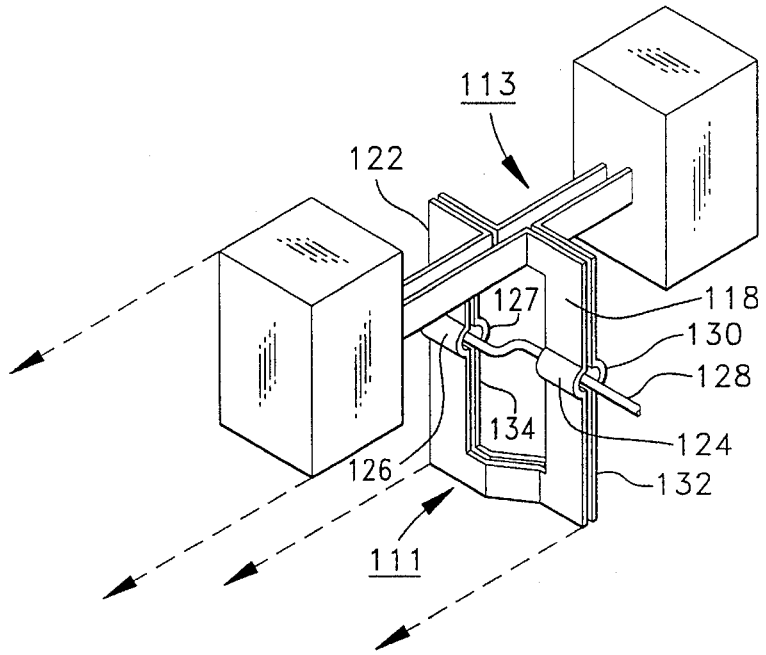
FIG. 7*b* is a perspective view of the apparatus of FIG. 7*a* shown in the heating position.

FIGS. 7*a* and 7*b* illustrates a further preferred adaptation of the present invention for induction heating workpieces of irregular size and shape, such as camshafts, crankshafts, or other large machine parts. This embodiment is adapted for movement between an open position (shown in FIG. 7*a*), for loading the workpiece into and unloading it from the apparatus, and a heating position in which the workpiece is enclosed by the coil for induction heating, as shown in FIG. 7*b*.

In the embodiment of FIG. 7*a*, two power supplies 110, 112 are connected to respective coil sections 111, 113. Coil section 111 comprises a first conductor element 114 connected at one end to the power supply 110. The power supply conductor element 114 is connected at its other end to a first transverse half-turn 118 of the coil section 111. Half-turn 118 extends across one surface of the workpiece 128 (as shown in FIG. 7*b*). A shunt conductor 120 connects the first transverse half-turn 118 to a second transverse half-turn 122 of the coil section 111. The second transverse half-turn 122 is spaced apart from the first half-turn 118 and extends back across the same side of the workpiece 128 as the first half-turn 118. The second half-turn 122 connects to a second connecting conductor element 116 that is connected to the other pole of the power supply 110.

A second coil section 113, formed to complement the shape and size of the first coil section 111, is connected to a second power supply 112. The second coil section 113 comprises two conductor elements 131, 133 connected to the second power supply 112 and a pair of transverse half-turns 132, 134. Transverse half-turns 132, 134 are spaced apart from each other and are connected by a shunt conductor 135 at the end opposite the power supply connection. Collectively, the half-turns 132, 134 of the second coil section 113 complement the half-turns 118, 122 of the first coil section 111 to form two full-turn coils around the workpiece 128 when the apparatus is in a heating position (shown in FIG. 7*b*).

To accommodate the heating of irregularly shaped workpieces, the respective half-turns 118, 122, 132, 134 of the coil sections 111, 113 include shaped portions 124, 126, 127, 130. The shaped portions 124, 126, 127, 130 conform to the shape of the workpiece 128 at the point(s) on the workpiece where the heating is to be applied. Each shaped portion 124, 126, 127, 130 forms one half of a full turn around the workpiece 128. The shaped portions form complementary pairs 124, 130 and 126, 127 that cooperate to fully enclose a segment of the workpiece for heating when the coil apparatus is placed in the heating position, as shown in FIG. 7*b*.

The shape and size of the shaped portions of the coil apparatus depends on the form and dimension of the workpieces to be heated. In some cases, such as that shown in FIGS. 7*a* and 7*b*, it may be necessary to offset the position of the respective half-turns 118, 122 and 132, 134 relative to each other to accommodate a non-linear workpiece.

As illustrated in FIG. 7*b*, the coil apparatus is operated in a heating position in which the two coil sections 111, 113 are moved together, enclosing the workpiece 128 within the complementary shaped portions 124/130, 126/127 of the half-turns in the coil sections. In the heating position, the joining of respective complementary half-turns 118, 132 and 122, 134 forms equivalent full-turn solenoidal coils around the workpiece 128.

In this configuration, two coil sections 111, 113, each a separate electrical circuit and physically separate from each other, can be used in combination to produce encircling induction circuits. Each circuit has a single current path which heats respective areas of the workpiece. The shaped portion of the coil turns makes it possible to heat particular segments of an irregularly shaped workpiece while maintaining tight magnetic coupling to the workpiece. Tight coupling is necessary for efficient use of the magnetic energy generated by the coil apparatus to induce heating currents in the workpiece.

The present invention may be embodied in other specific forms without departing from the spirit or essential attributes thereof. Accordingly, reference should be made to the appended claims, rather than to the foregoing specification, as indicating the scope of the invention. For example, while the solenoid-like turns have been constructed with right angles in the depicted embodiments to give a rectangular shape, it would be within the invention to round the comer edges. Hence, the claims may recite a "generally rectangular shape" to encompass the scope of the invention. Further, embodiments of the invention having more than two solenoid-like current paths are possible and fall within the claims of the invention.

We claim:

1. An induction heating apparatus comprising first and second coil sections each traversing a respective surface of a workpiece, and first and second power supplies for energizing each of the respective coil sections with alternating current, said first and second coil sections each comprising a conductor segment connected at a first end to one pole of one of said power supplies, a first transverse half-turn connected to a second end of the power supply conductor segment, said first transverse half-turn extending across a workpiece, a shunt conductor connecting said first transverse half-turn to a second transverse half-turn, said second transverse half-turn extending back across the same side of the workpiece as, and spaced apart from, said first half-turn, and a conductor segment connected at a first end to the second half-turn and at a second end to a second pole of the power supply, said first and second coil sections being arranged in a complementary configuration such that the first and second transverse half-turns of the respective coil sections combine to form respective first and second full turns of heating coil around the workpiece;

said first and second power supplies driving the respective first and second coil sections with currents having substantially a 180 degree phase relation between them.

2. The induction heating apparatus of claim 1 wherein said first and second full turns have a gap between the shunt conductors of the respective coil sections, said gap permitting a strip material workpiece to pass edgewise into and out of the coil apparatus.

3. The induction heating apparatus of claim 1 wherein the first and second power supplies provide substantially equal amplitude currents to the respective coil sections.

4. The induction heating apparatus of claim 1 wherein the first and second coil sections are adapted for movement between an open position and a heating position.

5. The induction heating apparatus of claim 4 wherein a portion of each of the transverse half-turns of the respective coil sections is sized and shaped so as to conform to the size and shape of the workpiece such that the workpiece is enclosed within the shaped portions of the transverse half-turns for heating.

6. An induction heating apparatus for heating an irregularly shaped workpiece comprising first and second coil sections and first and second power supplies for providing alternating current to the respective coil sections, said coil sections being adapted for movement between a heating position and an open position, said open position allowing loading and unloading of a workpiece to and from the apparatus, said heating position permitting a workpiece to be enclosed between the coil sections for heating by the apparatus, energized by the respective power supplies;

said first and second coil sections having complementary shape and size, said coil sections each comprising a first conductor element for connection to a first pole of one of said power supplies, a first transverse half-turn conductor extending from said power supply connecting conductor, said transverse half-turn conductor extending across one surface of a workpiece to be heated, a shunt conductor element connecting said first transverse half-turn to a second transverse half-turn conductor, said second half-turn conductor being spaced apart from the first transverse half-turn conductor and extending back across the surface of the workpiece substantially parallel to the first half-turn, said second half-turn conductor being connected to a second conductor element for connection to a second pole of the same one of said power supplies as the first power supply connecting element;

a portion of each of said transverse half-turns being shaped to conform to the size and shape of a workpiece to be heated, whereby the workpiece is positioned within the shaped portions of the transverse half-turns of one coil section in the open position of the apparatus, said workpiece being enclosed by the shaped portions of the transverse half-turns of the other coil section in the heating position of the apparatus;

said first and second power supplies driving the respective first and second coil sections with currents having substantially a 180 degree phase relation between them.

7. The induction heating apparatus of claim 6 wherein the complementary first transverse half-turns of the respective coil sections form a first full turn and the complementary second transverse half-turns of the respective coil sections form a second full turn in the heating position of the apparatus, said first and second full turns being spaced apart along a longitudinal axis through the workpiece.

8. The induction heating apparatus of claim 6 wherein the first and second power supplies provide substantially equal amplitude currents to the respective coil sections.

9. An induction heating apparatus for heating strip material comprising first and second coil sections, and first and second power supplies for providing alternating current to the respective coil sections, said first and second coil sections having complementary shape and size, said coil sections each comprising a first conductor element for connection to a first pole of one of said power supplies, a first transverse half-turn conductor extending from said power supply connecting conductor, said transverse half-turn conductor extending across one surface of a workpiece to be heated, a shunt conductor element connecting said first transverse half-turn to a second transverse half-turn conductor, said second half-turn conductor being spaced apart from the first transverse half-turn conductor and extending back across the surface of the workpiece substantially parallel to the first half-turn, said second half-turn conductor being connected to a second conductor element for connection to a second pole of the same one of said power supplies as the first power supply connecting element;

said first and second coil sections being arranged in a complementary configuration such that the first and second transverse half-turns of the respective coil sections combine to form respective first and second full turns of heating coil around the workpiece, said first and second full turns being spaced apart along a longitudinal axis through the workpiece;

each of said full-turn coils having a gap between the shunt conductors of each respective coil section, said gap between the shunt conductors of the respective first and second coil sections having a dimension that permits a strip material workpiece to pass edgewise into and out of the apparatus;

said first and second power supplies driving the respective first and second coil sections with currents having substantially a 180 degree phase relation between them.

10. The induction heating apparatus of claim 9 wherein the first and second power supplies provide substantially equal amplitude currents to the respective coil sections.

* * * * *